United States Patent [19]

Mood et al.

[11] 3,935,440

[45] Jan. 27, 1976

[54] CATAPULT BREAKAWAY LOAD SIMULATOR CIRCUIT

[75] Inventors: Robert D. Mood, Anaheim; Joseph P. Hunter, San Pedro; Dering R. Burgen, Pico Rivera, all of Calif.

[73] Assignee: The United States of America as represented by the Secretary of the Navy, Washington, D.C.

[22] Filed: Jan. 30, 1975

[21] Appl. No.: 545,688

[52] U.S. Cl. ..... 235/184; 235/150.53

[51] Int. Cl.[2] ..... G06G 7/70

[58] Field of Search ... 235/189, 197, 150.53, 150.2, 235/150.22

[56] References Cited

UNITED STATES PATENTS

| | | | |
|---|---|---|---|
| 3,296,421 | 1/1967 | Holt et al. | 235/150.22 |
| 3,506,819 | 4/1970 | Carli et al. | 235/189 |
| 3,621,228 | 11/1971 | Perlman | 235/197 |
| 3,651,317 | 3/1972 | Falk | 235/197 |
| 3,689,754 | 9/1972 | Le Febre | 235/150.53 |
| 3,760,173 | 9/1973 | Boita | 235/184 |

*Primary Examiner*—Felix D. Gruber
*Attorney, Agent, or Firm*—Richard S. Sciascia; Joseph M. St. Amand; Darrell E. Hollis

[57] ABSTRACT

A servo-control circuit for use in an electro-hydraulic system capable of simulating dynamic conditions for a controlled load vs. time history.

9 Claims, 2 Drawing Figures

CATAPULT BREAKAWAY LOAD SIMULATOR CIRCUIT

BACKGROUND OF THE INVENTION

1. Field of the Invention.

The present invention relates generally to servo-control circuits and, more particularly, to such circuits for use in electrohydraulic systems capable of simulating dynamic conditions for a controlled load vs. time history.

2. Description of the Prior Art.

A need has existed for some time for a system to simulate the dynamic effects on aircraft members during a typical catapult launch from an aircraft carrier. Such a system would enable scientists and engineers to experiment with such aircraft in a laboratory environment under controlled conditions. The present invention fills this long felt need.

SUMMARY OF THE INVENTION

The present invention provides a circuit for driving a servo-amplifier which in turn drives a mechanical linkage mechanism attached to an aircraft member. The circuit electronically simulates a controlled load vs. time history for an aircraft holdback fitting fracture when the required catapult load is reached.

Accordingly, one object of the present invention is to simulate a controlled load vs. time history.

Another object of the present invention is to simulate the dynamic effects on an aircraft member during a typical catapult launch.

Another object of the present invention is to reduce response time.

One other object of the present invention is to decrease expense and increase reliability.

Other objects and a more complete appreciation of the present invention and its many attendant advantages will develop as the same becomes better understood by reference to the following detailed description when considered in connection with the accompanying drawings in which like reference numerals designate like parts throughout the figures thereof and wherein.

DESCRIPTION OF THE PREFERRED EMBODIMENT

Figure 1:
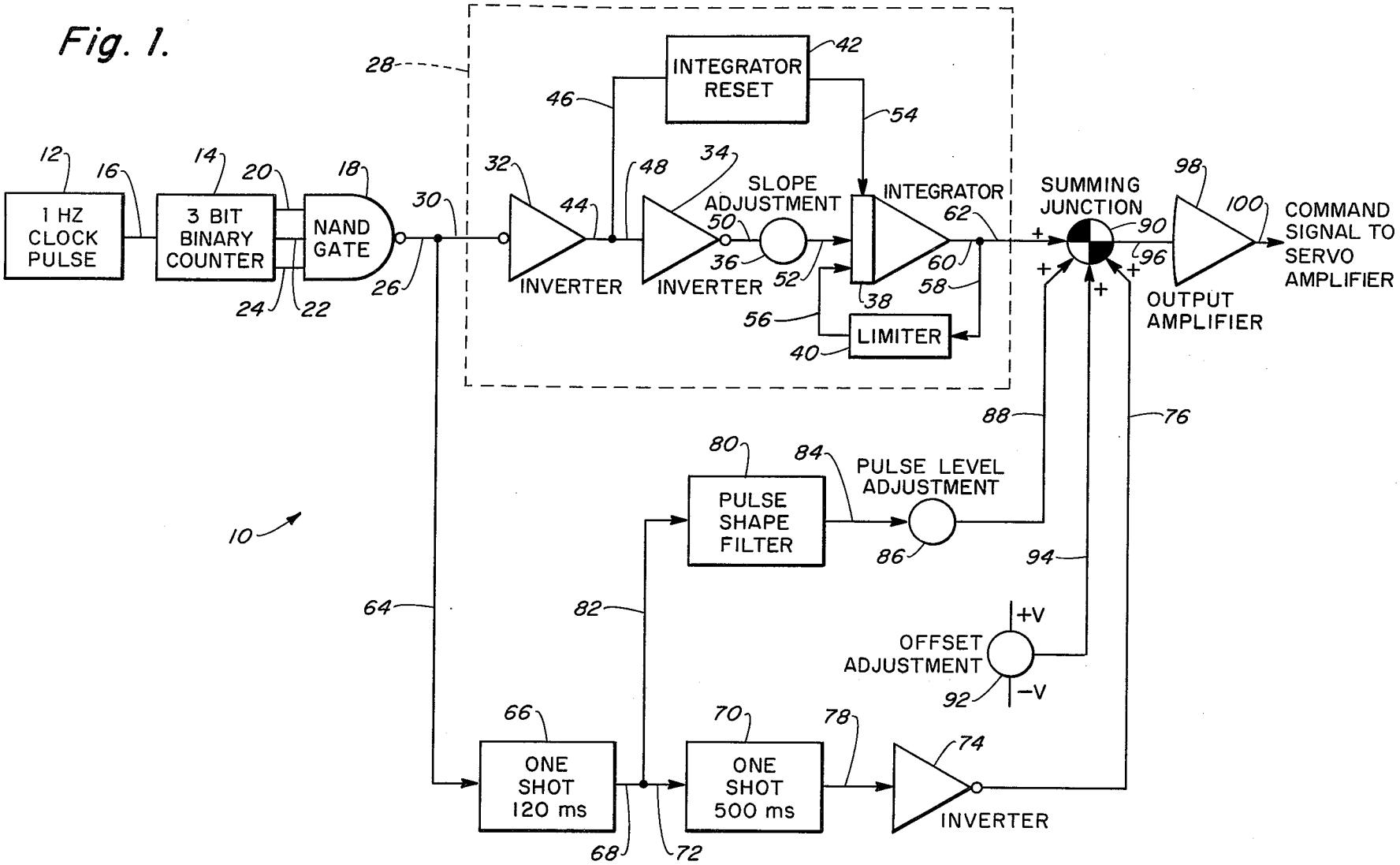
FIG. 1 illustrates a schematic diagram of a specific embodiment of the present invention.

Turning to FIG. 1 where simulator circuit 10 is illustrated, a one Hertz clock-pulse generator 12 is connected to a three-bit binary counter 14 via line 16. Three bit binary counter 14 is connected to NAND gate 18 via lines 20, 22, and 24. The driver signal output from NAND gate 18 on line 26 is illustrated in FIG. 2*b* while the clock signal on line 16 is illustrated in FIG. 2*a*. It is noted that the driver signal on line 26 is a seven second pulse of amplitude A followed by a one second zero voltage level.

Figure 2:
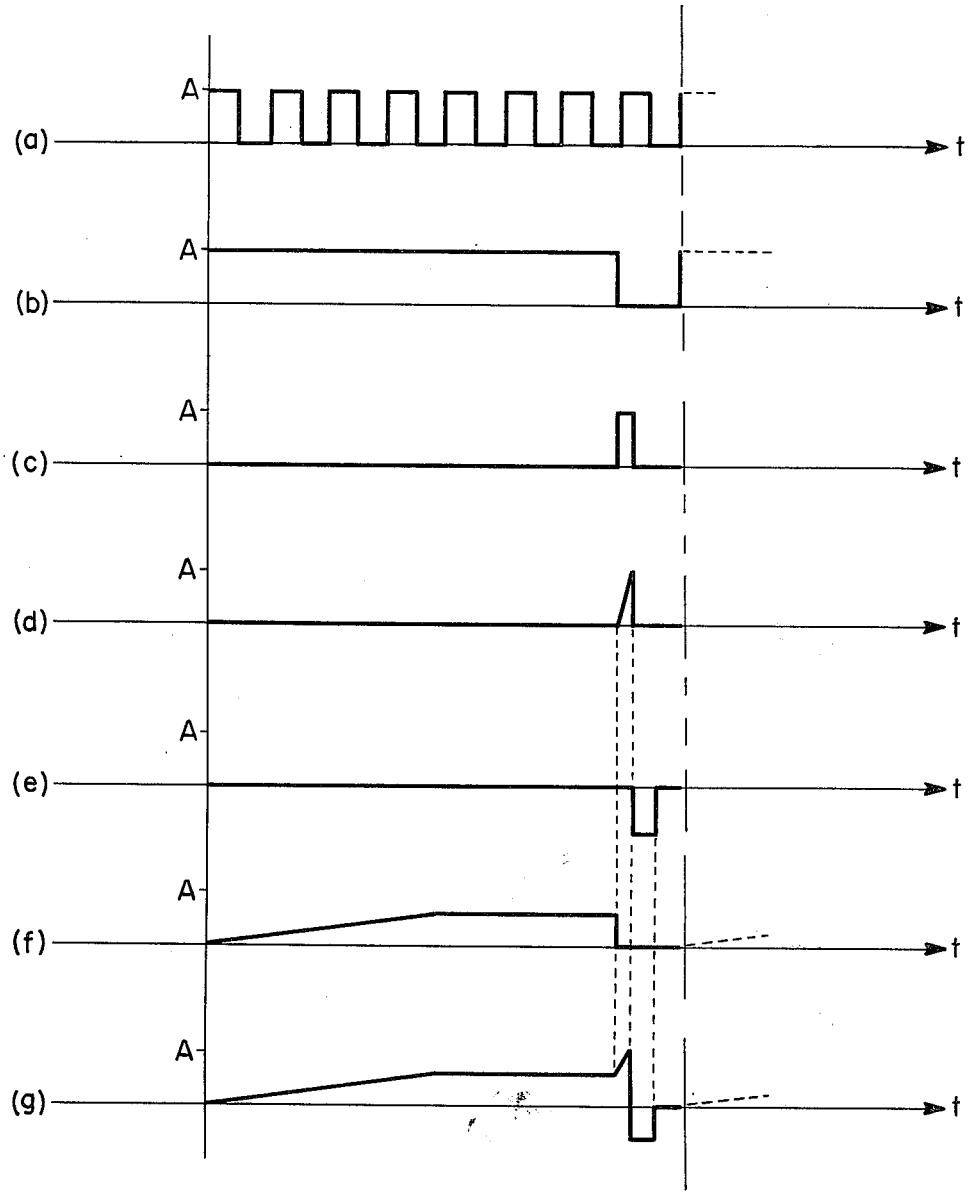
FIG. 2 illustrates a plurality of signals generated by the circuit of FIG. 1.

The driver signal on line 26 is connected to summing signal generator 28 via line 30. Summing signal generator 28 includes inverter 32, inverter 34, potentiometer 36, integrator 38, limiter 40 and integrator reset circuit 42 as well as interconnection lines 44, 46, 48, 50, 52, 54, 56, 58 and 60. Line 62 comprises the output of summing signal generator 28 upon which the summing signal illustrated in FIG. 2(*f*) appears. It is noted that the first seven seconds of the signal on line 30 (FIG. 2*b*) causes integrator 38 to develop a ramp output signal on line 60. The slope of the ramp output signal on line 60 may be adjusted by varying potentiometer 36. Limiter 40 is preset to limit the output on line 62 to a specific d-c voltage level. Thus, as illustrated in FIG. 2f potentiometer 36 adjusts the slope of the ramp signal output on line 60 so that the ramp signal reaches the specific d-c voltage level set by limiter 40 after four seconds. Then the output is limited on line 62 to the specific d-c voltage level set by limiter 40. The trailing edge of the seven second pulse of the driver signal on line 30 (FIG. 2b) causes integrator reset circuit 42 to reset integrator 38 back to a zero voltage. This is also illustrated in FIG. 2f.

The trailing edge of the seven second pulse of the driver signal on line 64 (FIG. 2*b*) also fires monostable multivibrator 66 for a time period of 120 milliseconds. The output of monostable multivibrator 66 appears on line 68 and is illustrated in FIG. 2c.

The driver signal on line 68 (FIG. 2*c*) inputs monostable multivibrator 70 via line 72. The trailing edge of the driver signal on line 68 (FIG. 2*c*) fires monostable multivibrator 70 for a time period of 500 milliseconds. This five hundred millisecond pulse is inverted by inverter 74 and appears as a summing signal on line 76. This summing signal appearing on line 76 is illustrated in FIG. 2*e*. Monostable multivibrator 70 is connected to inverter 74 via line 78.

The driver signal on line 68 also inputs pulse shaper filter 80 via line 82. Pulse shaper filter shapes the 120 millisecond square pulse on line 68 into a spike or steep ramp function pulse. This spike pulse appears on line 84. Line 84 inputs potentiometer 86 which may be utilized to adjust the spike pulse level. The level adjusted spike pulse appears as a summing signal on line 88 and is illustrated in FIG. 2*d*.

Potentiometer 92 may be utilized as a d-c voltage offset adjustment. The output of potentiometer 92 appears on line 94 as a summing signal.

Summing junction 90 sums the summing signals appearing on lines 76, 62, 88, and 94 with the sum appearing on line 96 which inputs output amplifier 98. Output amplifier 98 outputs a servo-driver signal on line 100 which is illustrated in FIG. 2*g*. The signal on line 100 drives a servo-amplifier (not shown) which in turn actuates a mechanical linkage that is attached to an aircraft member.

The signal illustrated in FIG. 2*g* is utilized to simulate the dynamic effect on the aft fuselage structure of an A4 aircraft during a typical catapult launch. In particular, to simulate the holdback fitting fracture which occurs when the required catapult load is reached.

FIG. 2*g* illustrates the load vs. time history for the holdback fitting fracture. First, a slow four second ramp to 12,500 pounds is developed. Then, a holding time of three seconds follows terminated by a 120 millisecond pulse to reach the nominal breakaway failing load of 28,500 pounds. The final event is to simulate the actual breaking of the fitting by commanding an instantaneous zero load. This is accomplished by actually developing a negative load. This negative load is not actually felt by the aircraft member since the mechanical linkage will not support a compression load. The signal in FIG. 2*g* develops a high negative load to give the servo amplifier a large negative error signal.

It is noted that the clock pulse signal illustrated in FIG. 2*a* is a one Hertz signal. However, for different applications different frequencies may be utilized. Also, the time periods associated with monostable multivibrators 66 and 70 are mere matters of design choice. Such time periods may vary for other applications.

From an inspection of FIG. 2, it is noted that for every eight cycles of the clock pulse signal (FIG. 2*a*) the servo driver signal (FIG. 2*g*) is repeated.

It will be appreciated by those skilled in the art that the complete circuit diagram of FIG. 1 includes such suitable and necessary biasing voltage sources as are usually provided in simulator circuits. Such biasing is not shown in FIG. 1.

Obviously, numerous modifications and variations of the present invention are possible in light of the above teachings. It is therefore to be understood that within the scope of the appended claims the invention may be practiced otherwise than as specifically described herein.

I claim:

1. A circuit for developing a required load vs. time signal to simulate the breakaway fitting load during a typical catapult launch comprising:

a. means for providing a clock pulse signal, said signal having a first amplitude, b. means connected to said clock signal providing means for generating a first driver signal, said first driver signal being said first amplitude for a time period equal to seven cycles of said clock pulse signal followed by a second amplitude for a time period equal to one cycle of said clock pulse signal, said first amplitude being greater in value than that said second value, said first driver signal repeating once every eight cycles of said clock signal, c. means connected to said first driver signal generating means for generating a first summing signal, said first summing signal being a ramp function starting at said second amplitude and terminating at a third amplitude with a time period equal to four cycles of said clock signal, followed by said third amplitude for a time period equal to three cycles of said clock signal, followed by said second amplitude for a time period equal to one cycle of said clock signal, said third amplitude being less than said first amplitude but greater than said second amplitude, said first summing signal repeating once every eight cycles of said clock signal, d. means connected to said first driver signal generating means for generating a second driver signal, said second driver signal being said second amplitude for a time period of seven cycles of said clock signal followed by said first amplitude for a time period of less than one cycle of said clock signal, followed by said second amplitude for the remainder of the eights cycle of said clock signal a time period of less than one cycle of said clock signal, said second driver signal repeating once every eight cycles of said clock signal, e. means connected to said second driver signal generating means for generating a second summing signal, said second summing signal being said second amplitude for a time period equal to seven cycles of said clock signal, followed by a spike pulse signal of amplitude equal to said first amplitude for a time period of less than one cycle, followed by said second amplitude for a time period of less than one cycle, said second summing signal repeating once every eight cycles of said clock signal, f. means connected to said second driver signal generating means for generating a third summing signal, said third summing signal being said second amplitude for a time period equal to more than seven cycles of said clock signal but less than eight cycles of said clock signal followed by a fourth amplitude for a time period equal to less than one cycle of said clock signal, said fourth amplitude being less than said second amplitude, said third summing signal repeating once every eighth cycle of said clock signal, and g. summing means connected to said first, second, and third summing signal generator means for summing said first, second, and third summing signals, said summing means having an output upon which appears said load vs. time signal, said load vs. time signal repeating once every eight cycles of said clock signal.

2. The circuit of claim 1 further comprising a means for providing a fourth summing signal, said fourth summing signal being an adjustable d-c level for a time period of eight cycles of said clock signal, said fourth summing signal being inputted to said summing means and summed with said first, second, and third summing signals.

3. The circuit of claim 1 wherein said first driver signal generating means comprises:

a. a three-bit binary counter inputted by said clock pulses, said counter having three outputs, and b. a NAND gate inputted by said three counter outputs, said NAND gate having an output upon which said first driver signal appears.

4. The circuit of claim 1 wherein said first summing signal generating means comprises:

a. a first inverter having an input connected to receive said first driver signal, said first inverter having an output, b. a second inverter having an output and an input, said second inverter input being connected to said first inverter output, c. a slope adjustment potentiometer having an input and an output, said potentiometer input being connected to said second inverter output, d. an integrator having an output and a first, second and third input, said second integrator input being connected to said potentiometer output, said first summing signal appearing on said integrator output, e. an integrator reset circuit connected between said first inverter output and said first integrator input, said integrator reset circuit resetting said integrator every seventh cycle of said clock signal, and f. a limiter circuit connected between said third integrator input and said integrator output, said limiter circuit holding said first summing signal at said third amplitude when said ramp function segment reaches said third amplitude.

5. The circuit of claim 1 wherein said second driver signal generating means comprises a first monostable multivibrator having an output, said first monostable multivibrator input being connected to receive said first driver signal, said second driver signal appearing on said first monostable multivibrator output.

6. The circuit of claim 1 wherein said time period of less than one cycle of said clock signal at said first amplitude is one-hundred and twenty milliseconds.

7. The circuit of claim 1 wherein said second summing signal generating means comprises:

a. a pulse shape filter having an input and an output, said input being connected to said first monostable multivibrator output, and b. a pulse level adjustment potentiometer having an input and an output, said potentiometer input being connected to said filter output, said second summing signal appearing on said potentiometer output.

8. The circuit of claim 1 wherein said third summing signal generating means comprises:

a. a second monostable multivibrator having an input and an output, said second monostable multivibrator input being connected to receive said second driver signal, b. a third inverter having an input and an output, said third inverter input being connected to said second monostable multivibrator output, said third summing signal appearing on said third inverter output.

9. The circuit of claim 1 wherein said time period of less than one cycle of said clock signal at said third amplitude is five-hundred milliseconds.

* * * * *